US006661401B1

(12) United States Patent
Sekine

(10) Patent No.: US 6,661,401 B1
(45) Date of Patent: Dec. 9, 2003

(54) CIRCUIT FOR DRIVING A LIQUID CRYSTAL DISPLAY AND METHOD FOR DRIVING THE SAME CIRCUIT

(75) Inventor: Hiroyuki Sekine, Tokyo (JP)

(73) Assignee: NEC Corporation, Tokyo (JP)

( * ) Notice: Subject to any disclaimer, the term of this patent is extended or adjusted under 35 U.S.C. 154(b) by 71 days.

(21) Appl. No.: 09/711,632

(22) Filed: Nov. 13, 2000

(30) Foreign Application Priority Data

Nov. 11, 1999 (JP) ..... 11-321389

(51) Int. Cl.[7] ..... G09G 3/36

(52) U.S. Cl. ..... 345/92; 345/87; 345/88; 345/96; 345/97; 345/98; 345/99; 345/100; 345/101; 345/102; 345/103

(58) Field of Search ..... 345/4, 6, 87, 88, 345/92, 96–103

(56) References Cited

U.S. PATENT DOCUMENTS 5,153,568 A * 10/1992 Shaw ..... 345/589
5,298,892 A * 3/1994 Shapiro et al. ..... 345/4
5,302,946 A * 4/1994 Shapiro et al. ..... 345/208
5,745,093 A * 4/1998 Tsuzuki et al. ..... 345/103
6,163,310 A * 12/2000 Jinno et al. ..... 16/26

FOREIGN PATENT DOCUMENTS

JP 8-190083 7/1996
JP 10-69256 3/1998
JP 10-105126 4/1998

* cited by examiner

*Primary Examiner*—Richard Hjerpe
*Assistant Examiner*—Jean Lesperance
(74) *Attorney, Agent, or Firm*—Choate, Hall & Stewart

(57) ABSTRACT

In a drive circuit for driving a liquid crystal display, a video signal generating block for generating a video signal to be supplied to a display panel, includes, for each of R (red), G (green) and B (blue), and coupled in the named order, a ADC circuit for analog-to-digital converting a video signal, two memories each having a capacity which can hold signals of one line of the display panel, a V-T compensation circuit for compensating a non-linearity of a transparent light strength to an input voltage of the display panel, a polarity inverting circuit for an AC driving of liquid crystal pixels in the display panel, a DAC circuit for digital-to-analog converting the digital signal outputted from the polarity inverting circuit, and an output selection circuit for supplying a precharge voltage to the display panel. The output selection circuit displays the analog signal outputted from the DAC circuit, during a period which is a half of one horizontal period of the video signal, and precharges the display panel during a latter half of the horizontal period. With this arrangement, a precharge circuit can be eliminated from the liquid crystal display panel, and the size of the panel can be reduced. In addition, a variation in the precharging in the display panel can be eliminated, and an uniform image can be displayed over the whole of the panel. Furthermore, the yield of production can be elevated as a whole.

6 Claims, 8 Drawing Sheets

CIRCUIT FOR DRIVING A LIQUID CRYSTAL DISPLAY AND METHOD FOR DRIVING THE SAME CIRCUIT

BACKGROUND OF THE INVENTION

The present invention relates to an active matrix type liquid crystal display and a method for driving the same.

In an active matrix type liquid crystal display so configured that an active element for switching each pixel in a liquid crystal display is formed of a TFT (thin film transistor), particularly, when a poly-Si (polysilicon) material is used for the TFT, it is frequently used for the liquid crystal display which is required to have a small size, such as a liquid crystal display for a projector, since it has a large current driving capability in comparison with an a-Si (amorphous silicon) TFT and others, and since a portion of a driving circuit for the liquid crystal display can be simultaneously formed on a glass plate.

A prior art example of the liquid crystal display integrated with such a driving circuit is shown in FIG. 7. This is constituted of a pixel matrix having a pixel TFT (Mpix), a pixel capacitance (Clc) of a liquid crystal cell and a storage capacitance (Cst), which are located at each of intersections between data lines and gate lines located vertically and horizontally, respectively, a data driver circuit for driving the data lines (D1 to Dn), a gate driver circuit for driving the gate lines (G1 to Gm), and a precharge circuit having gates connected to receive a precharge controlling voltage for resetting a potential of the data lines (D1 to Dn) to a certain voltage.

The gate driver circuit sequentially drives the "m" gate lines to a high level. The data driver circuit is constituted of a scan circuit having "n" outputs and "n" analog switch TFTs (S1 to Sn). This scan circuit sequentially transfers data of a start signal DST in synchronism with a clock DCLK. The precharge circuit is constituted of "n" switches (P1 to Pn), a gate of each of which is connected to a control terminal PCG, and a source/drain terminal of each of which is connected to a terminal PCS. Here, the pixel TFTs, the analog switch TFTs and the switch TFTs of the precharge circuit are formed of an n-channel transistor which is brought into a conducting condition when a high level voltage is applied to a gate electrode.

Now, an operation of this liquid crystal display will be described with reference to a timing chart shown in FIG. 8. Here, TH(i) in the drawing indicates one horizontal period during which a video signal of one line in the pixel matrix is supplied. The start signal DST of the data driver circuit is applied in synchronism with the clocks DCLK so that the start signal DST is brought to a high level one time per one horizontal period. Thus, the scan circuit sequentially transfers the start signal DST in synchronism with the clocks DCLK, so that a pulse is outputted from outputs SP1, SP2, . . . of the scan circuit as shown in the drawing. The output terminals of the scan circuit are connected to the analog switch TFTs, so that the "n" analog switch TFTs are sequentially turned on and off in synchronism with the clocks DCLK.

Here, if a video signal Vsig is supplied to the liquid crystal display in synchronism with the clocks DCLK, the video signal is sequentially sampled to the data lines. In this horizontal period, since the gate line Gj (where "j" is an integer fulfilling a relation of 1_j_m) is maintained at a high level, the video signal sampled to the data lines are written through the pixel TFTs to the liquid crystal cell Clc, Cst of the pixels. After the gate line Gj is brought to a low level, if the potential of the control signal PCG is brought to the high level during a certain period, all the switch TFTs in the precharge circuit are put into a conducting condition, so that all the data lines are reset to a voltage supplied to the terminal PCS. The above mentioned operation is executed for all the gate lines, so that a two-dimension image can be displayed.

The explanation of this timing chart is based on the assumption that the liquid crystal display is driven in a gate line inversion mode, in which during a period of supplying the liquid crystal display with a video signal positive in comparison with Vcom (opposing electrode voltage), Vps is applied to the terminal PCS as a potential for resetting the data lines, and during a period of supplying the liquid crystal display with a video signal negative in comparison with Vcom, Vng is applied to the terminal PCS as a potential for resetting the data lines.

Here, the reason for carrying out the precharging will be described. If the driving called the precharging or the previous charging is carried out, it is possible to reduce a brightness unevenness in the form of stripes in parallel to the data lines. The cause of generation of this brightness unevenness is considered to be that the video signal voltages written to the data lines become varied because of dispersion of characteristics in respective TFTs used as the analog switches. However, if the precharging is carried out, Vps or Vng is written into the data lines by means of the precharging before the video signal is written to the data lines through the analog switches, with the result that when the video signal voltages are written, the potential of the data lines is caused to change from Vps or Vng to the video signal potential. Namely, the potential of the data line changes from a value near to a potential of the video signal to be written next, regardless of the potential of the video signal to be written previously, so that the amount of the potential change of the data line becomes small. Therefore, even the analog switch TFTs are dispersed in characteristics, the variation in the voltages written into the data lines becomes small.

As mentioned above, it is possible to elevate the image quality by means of the precharging, however, the following new problems are encountered.

First, a dedicated circuit for carrying out the precharging becomes necessary, with the result that the size of the liquid crystal display becomes large because of the dedicated circuit. In addition, by providing the precharging circuit, the number of TFTs constituting the liquid crystal display becomes large, so that the yield of production lowers.

Secondly, under this system, it is required to carry out the precharging during a short horizontal blanking period which is a partial period of the horizontal period in which no video signal is applied. Therefore, an external circuit for supplying the voltage to the precharging circuit has to have a large driving capability. The reason for this is that since all the data lines are driven at a time, the capacitance becomes large.

Thirdly, the effect of the precharging is different from one place to another in the liquid crystal display. The reason for this is that, the video signal is written into the liquid crystal display in the order from left to right, but the precharge is carried out for the whole surface of the liquid crystal display at a time, with the result that the time from the precharge to the moment that the video signal is written is different from one place to another in the liquid crystal display.

BRIEF SUMMARY OF THE INVENTION

Accordingly, it is an object of the present invention to provide a drive circuit for driving an active matrix type liquid crystal display and a driving method for a liquid crystal display drive circuit, capable of improving the yield of production by eliminating the precharge circuit from the liquid crystal display panel, and of minimizing the display variation over the whole of the liquid crystal display panel by carrying out the precharging in a period different from the horizontal blanking period.

According to a first aspect of the present invention, there is provided a drive circuit for driving an active matrix type liquid crystal display, comprising a video signal generating block, a timing control block for supplying timing signals to various parts in the liquid crystal display, and a panel control pulse generation block for supplying control pulses for scanning in the liquid crystal display, wherein the video signal generating block for generating a video signal to be supplied to the liquid crystal display, includes, for each of liquid crystal display systems for R (red), G (green) and B (blue), and coupled in the named order, a ADC circuit for converting an analog signal from a signal source of a video signal for a display, into a digital signal, two memories each having a capacity which can hold signals of one line of the liquid crystal display, a V-T compensation circuit for compensating a non-linearity of a transparent light strength to an input voltage of the liquid crystal display, a polarity inverting circuit for an AC driving of liquid crystal pixels in the liquid crystal display, a DAC circuit for converting the digital signal outputted from the polarity inverting circuit, into an analog signal, and an output selection circuit for switching an output to be applied to the liquid crystal display, so as to supply the switched output to the liquid crystal display, the output selection circuit being configured to display the analog signal outputted from the DAC circuit, during a period which is a half of one horizontal period of the video signal, and to precharge the liquid crystal display during a latter half of the horizontal period.

According to a second aspect of the present invention, there is provided a drive circuit for driving an active matrix type liquid crystal display, comprising a video signal generating block, a timing control block for supplying timing signals to various parts in the liquid crystal display, and a panel control pulse generation block for supplying control pulses for scanning in the liquid crystal display, wherein the video signal generating block for generating a video signal to be supplied to the liquid crystal display, includes, for each of liquid crystal display systems for R (red), G (green) and B (blue), and coupled in the named order, a ADC circuit for converting an analog signal from a signal source of a video signal for a display, into a digital signal, two memories each having a capacity which can hold signals of one line of the liquid crystal display, a V-T compensation circuit for compensating a non-linearity of a transparent light strength to an input voltage of the liquid crystal display, a polarity inverting circuit for an AC driving of liquid crystal pixels in the liquid crystal display, a parallel development circuit for developing the video signal into a plurality of parallel video signals, a DAC circuit for converting the digital signal outputted from the polarity inverting circuit, into an analog signal, and an output selection circuit for switching an output to be applied to the liquid crystal display.

According to a third aspect of the present invention, there is provided a method for driving the above mentioned drive circuit for the liquid crystal display, wherein, in the above mentioned drive circuit for the liquid crystal display, the two memories are alternately repeatedly read and posed, and written and posed, at a double speed in such a manner that when one of the two memories is in a reading condition, the other of the two memories is in a writing condition, and after the output selection circuit outputs the video signal read from the memory, the output selection circuit is put in a precharging period.

According to a fourth aspect of the present invention, there is provided a method for driving the drive circuit for the liquid crystal display, wherein such an operation is carried out in which once the video signal of one line is stored from the signal source into the memory, the video signal is read out from the memory at a frequency which is not less than a double of the frequency of the video signal of the signal source, so that the video signal of one line is written into the liquid crystal display during a period which is not greater than a half of one horizontal period, and the precharge voltage is written into the liquid crystal display during a remaining period of the one horizontal period, and wherein the writing of the video signal into the liquid crystal display and the writing of the precharge voltage into the liquid crystal display can be respectively parallelized by the number of video signal wiring conductors in the liquid crystal display.

Explaining conceptually, the driving method of the present invention is characterized in that, once the video signal to be applied to the liquid crystal display is stored in a memory, the video signal is quickly read out from the memory and written into the liquid crystal display, so that a blanking period in one horizontal period is elongated, and during this blanking period, a precharge voltage is written into data lines through analog switches, similarly to the video signal.

DETAILED DESCRIPTION OF THE INVENTION

Embodiments of the present invention will be described in detail with reference to the drawings.

First Embodiment (1) Explanation of Construction

Figure 1:
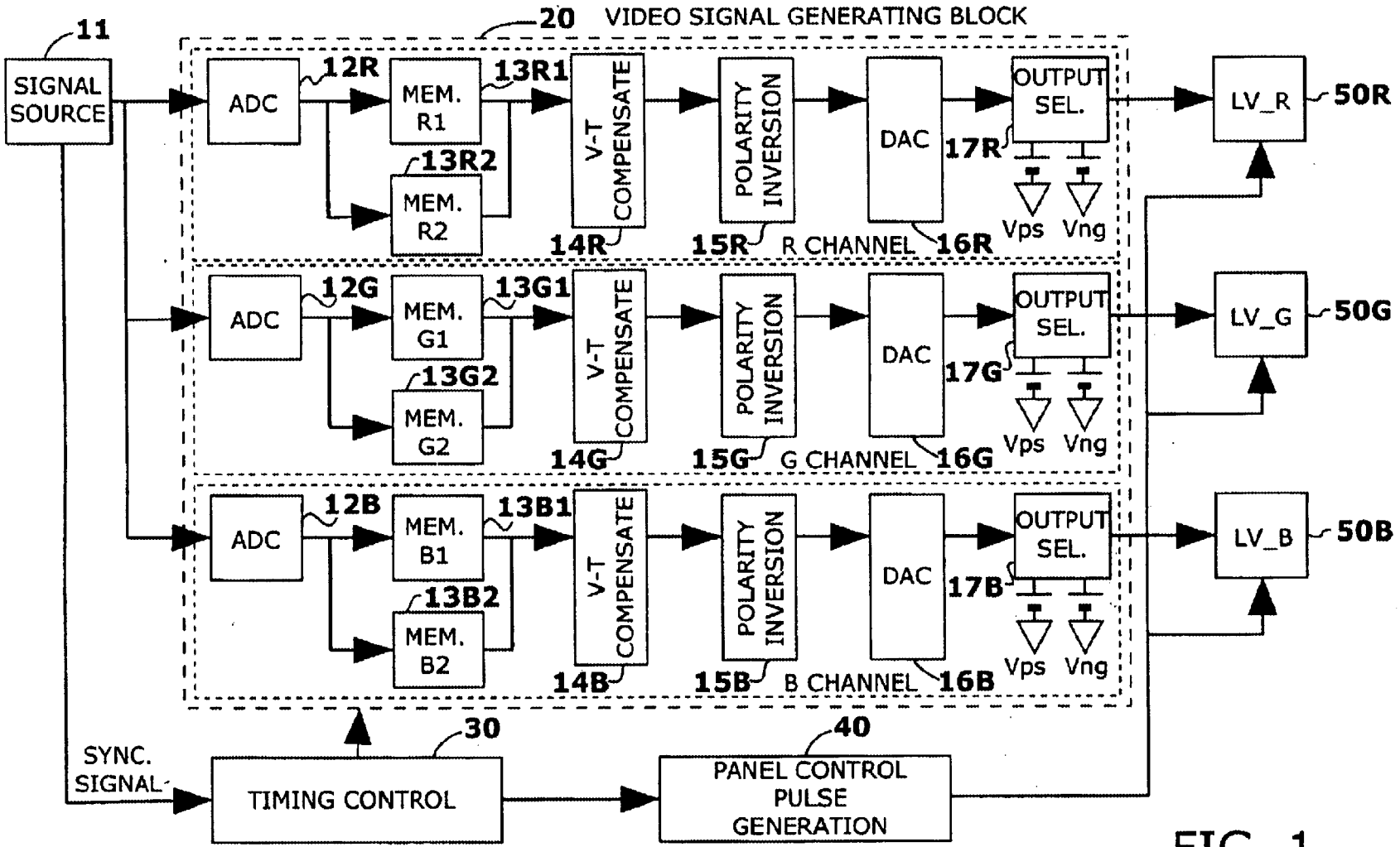
FIG. 1 is a block diagram showing mainly a video signal generating block in accordance with a first embodiment of the present invention.

FIG. 1 shows a block diagram of a panel drive circuit for realizing the method for driving an active matrix type liquid crystal display in accordance with a first embodiment of the present invention. This circuit can be generally divided into a video signal generating block 20, a timing control block 30, a panel control pulse generation block 40 and liquid crystal displays 50.

The panel control pulse generation block 40 generates control pulses required to driving an internal circuit of the liquid crystal displays 50, and the video signal generating block 20 generates a video signal to be applied to the liquid crystal displays 50.

The timing control block 30 detects a synchronism signal from a signal source 11 of the video signal by action of a synchronism signal separation circuit, and generates, in synchronism with this synchronism signal, signals for controlling the panel control pulse generation block 40 and the video signal generating block 20.

For each of the liquid crystal displays 50 for R (red), G (green) and B (blue), the video signal generating block 20 comprises a ADC circuit for digitizing an analog signal from the signal source 11, two memories 13 each which can hold signals of one line of the liquid crystal display 50, a V-T compensation circuit for compensating a non-linearity of a transparent light strength to an input voltage of the liquid crystal display 50, a polarity inverting circuit 15 for an AC driving of liquid crystal pixels, a DAC circuit 16 for converting the digital signal into an analog signal, and an output selection circuit 17 for switching an output to be applied to the liquid crystal display 50.

Figure 2:
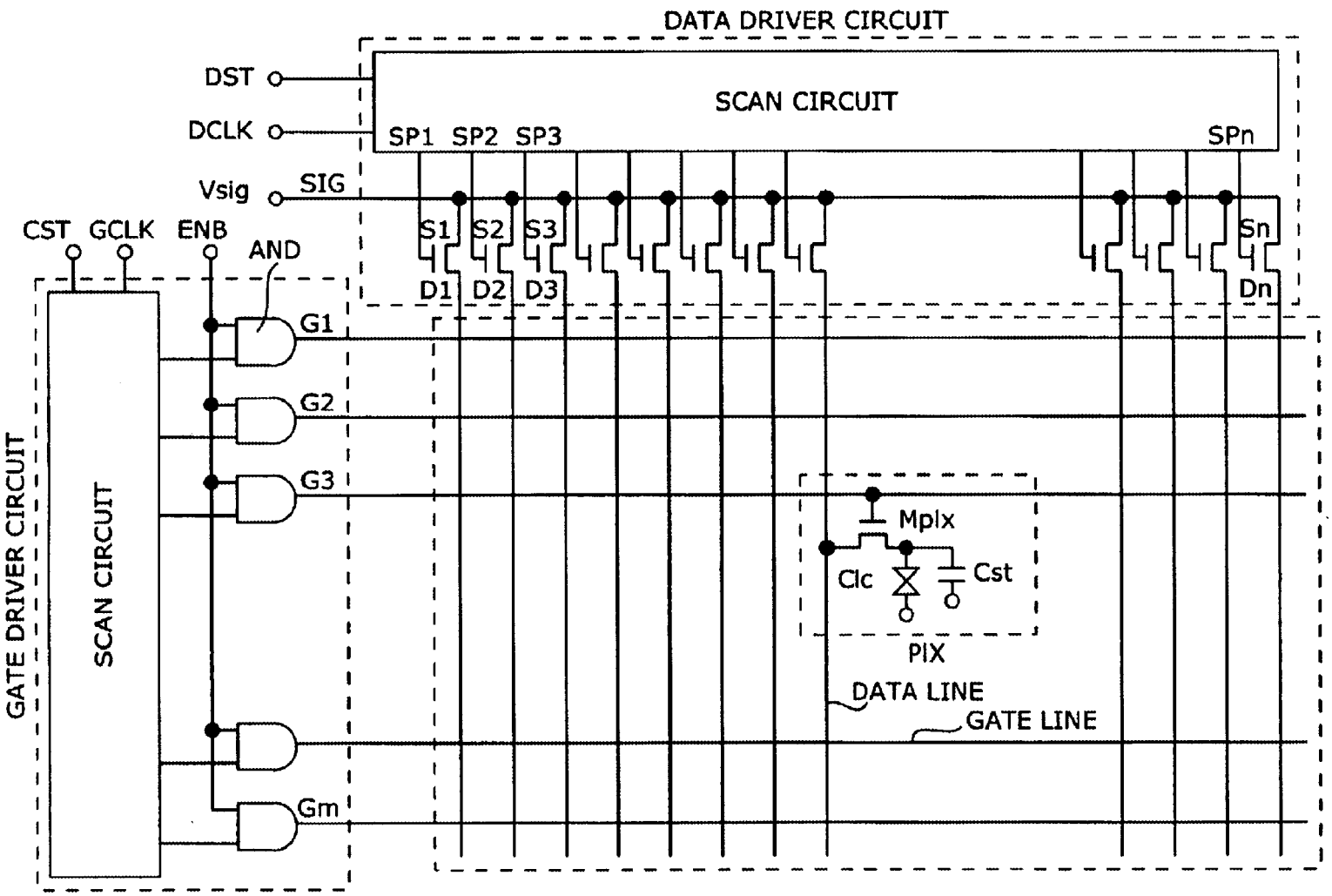
FIG. 2 is a circuit diagram for illustrating a method for driving the liquid crystal display in accordance with the present invention.

FIG. 2 shows one example of the construction of an active matrix type liquid crystal display driven by this driving method. The active matrix type liquid crystal display shown in FIG. 2 includes a pixel matrix having pixels PIX each of which is composed of a TFT (Mpix) (which is an active element), a pixel capacitance (Clc) of a liquid crystal cell and a storage capacitance (Cst), and which are respectively located at intersections between data lines (D1 to Dn) and gate lines (G1 to Gm) located vertically and horizontally, respectively, a data driver circuit for driving the data lines, a gate driver circuit for driving the gate lines.

The data driver circuit is constituted of analog switch (ASW) TFTs of the number which is equal to or more than the number of the data lines, and a scan circuit having "n" outputs of the same number as that of those ASW TFTs. A source terminal of the ASW TFTs are connected to the data lines D1, D2, . . . , Dn, respectively, and a drain terminal of the ASW TFTs are connected to the video signal line SIG. A gate terminal of the ASW TFTs are connected to the output terminals SP1, SP2, . . . , SPn of the scan circuit, respectively.

The gate driver circuit is constituted of a scan circuit and an AND gate array. Input terminals of respective AND gates are connected to output terminals of the scan circuit, respectively, at one hand, and in common to a common ENB line at the other hand. An output terminal of the AND gates are connected to the gate lines, respectively.

(2) Explanation of Operation

Figure 3:
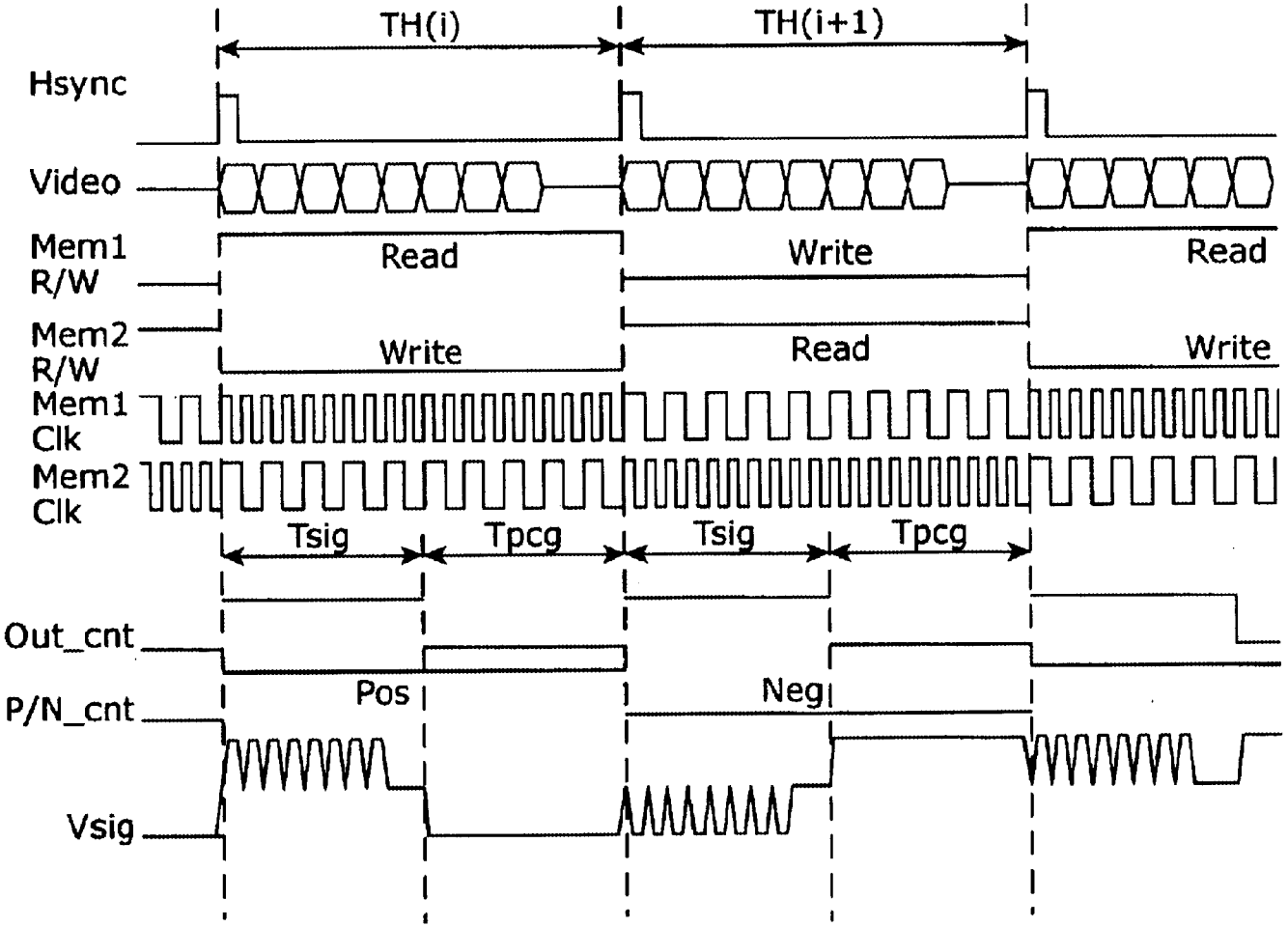
FIG. 3 is a timing chart for illustrating the video signal generating block in accordance with the first embodiment of the present invention.

An operation of the panel driving circuit will be described with reference to the timing chart shown in FIG. 3. The shown example is an example in which the liquid crystal display is driven in a gate line inversion mode. "Hsync" in the timing chart indicates the horizontal synchronism signal, and horizontal periods are designated with TH(i) and TH(i+1). "Video" denotes a video signal outputted from the signal source, and "Mem1R/W" and "Mem2R/W" show signals for controlling whether the memory "MEM1" should be put in a read operation or a write operation, and whether the memory "MEM2" should be put in a read operation or a write operation, respectively. "Mem1Clk" and "Mem2Clk" designate clocks generated on the basis of the timing signal from the timing control block 30, for controlling the memories "MEM1" and "MEM2", respectively. "Out_cnt" and "P/N_cnt" are signals generated on the basis of the timing signal from the timing control block 30, for controlling the output selection circuit 17. When "Out_cnt" is at a high level, an output of the digital-to-analog conversion circuit (DAC) 16 is selected, and when "Out_cnt" is at a low level, either the precharge voltage Vps or Vng is selected. Which of the precharge voltages Vps and Vng is to be selected, is determined by the control signal "P/n_cnt". When "P/N cnt" is at the high level, the precharge voltage Vps is selected, and when "Out_cnt" is at the low level and "P/N_cnt" is at the low level, the precharge voltage Vng is selected. In this example, the voltage Vps is a voltage near to the ground voltage, and the voltage Vng is set to be voltage higher than a signal level.

Now, an operation during one horizontal period TH(i) will be described. In this period, since "Mem1R/W" indicates the reading and "Mem2R/W" indicates the writing, the video signal supplied from the signal source is digitized by the ADC circuit 12, and then, written into the memory 2. At this time, the clock signal "Mem2Clk" supplied to the memory 2, is equal to the frequency of the video signal from the signal source 11. On the other hand, the contents of the memory 1 are read out, and sent to the V-T compensation circuit 14. At this time, the clock frequency for reading out the memory 1 is not less than a double of the writing frequency. Therefore, all the video signal data of the horizontal period TH(i–1) stored in the memory 1 is transferred to the V-T compensation circuit 14 during a period Tsig which is not greater than a half of one horizontal period TH, and is supplied through the polarity inverting circuit 15, the DAC circuit 16 and the output selection circuit 17 to the liquid crystal display 50.

After all the video signal of one line is applied to the liquid crystal panel, the control signal "Out_cnt" for the output selection circuit 17 is brought into the low level during a period Tpcg. Furthermore, since "P/N cnt" is at the high level, the precharge voltage Vps is applied to the liquid crystal panel 50.

In a next horizontal period TH(i+1), since "Mem1R/W" indicates the writing and "Mem2R/W" indicates the reading, the video signal supplied from the signal source is written into the memory 1, and the video signal written in the memory 2 during the horizontal period TH(i) is read out. At this time, the frequency for writing the memory is the frequency of the video signal of the signal source 11, but the frequency for reading out the memory 1 is not less than a double of the writing frequency. Similarly to the period TH(i), the video signal read out from the memory is supplied, during the period Tsig, through the V-T compensation circuit 14, the polarity inverting circuit 15, the DAC circuit 16 and the output selection circuit 17 to the liquid crystal display 50. During the period Tpcg, since "P/N_cnt" is at the low level, the precharge voltage Vng is selected and applied to the liquid crystal display 50.

Namely, this panel circuit operates in such a manner that once the video signal of one horizontal line from the signal source 11 is stored in the memory, and then, read out at the frequency which is not less than a double of the video signal frequency of the signal source 11, so that the video signal of the one horizontal line is written into the liquid crystal display 50 during a period which is not greater than a half of one horizontal period, and during a remaining period, the precharge voltage is applied to the liquid crystal display 50.

In addition, the precharge voltage applied to the output selection circuit 17 is different from one horizontal period to another, dependently upon what polarity of video signal is applied in a next period.

Figure 4:
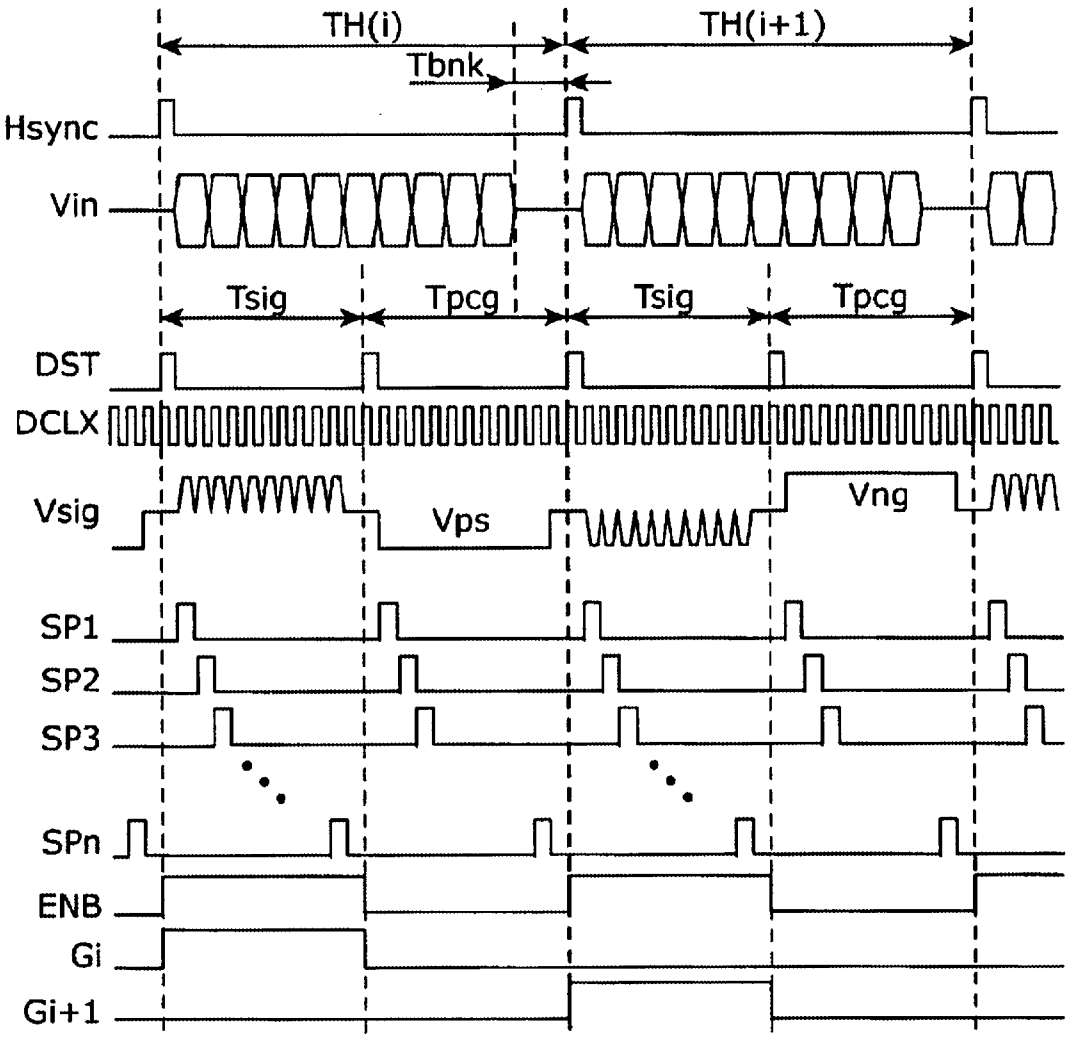
FIG. 4 is a timing chart for illustrating the method for driving the liquid crystal display in accordance with the present invention.

Next, an operation of the liquid crystal display 50 will be described with reference to a timing chart shown in FIG. 4. The scan circuit in the data driver circuit shown in FIG. 2 for selecting the data line in the liquid crystal display 50 operates to sequentially transfer the content of the input signals DST in synchronism with the control clocks DCLK.

Here, the frequency of the clock signals DCLK is made equal to the memory reading frequency in the panel driving circuit, and during each one horizontal period TH, the start signal DST is brought to the high level one time at a starting time of the period Tsig and one time at a starting time of the period Tpcg, respectively. With this arrangement, as shown, each of the output terminals SP1 to SPn of the scan circuit outputs a pulse in synchronism with the clock signal DCLK, one time for each of the period Tsig and the period Tpcg. Since the output terminals of the scan circuit are connected to a gate of the analog switches ASW, respectively, the video signal applied on a video signal wiring conductor SIG is sequentially sampled to corresponding data lines through the analog switches ASW during the period Tsig.

Furthermore, since a gate line Gi is at a high level, the video signal is written into the pixel capacitance and the storage capacitance in an (i)th line of pixels, respectively. During the period Tpcg, the precharge voltage Vps or Vng applied on the video signal wiring conductor SIG is sequentially sampled to the data lines. However, since the output control signal ENB for the gate driver circuit is at a low level during this period, each of the gate lines is maintained at a low level, so that the potential of the data line is in no way written into the pixels.

By carrying out the above mentioned operation for all the gate lines, the video signal can be written into all the pixels in the liquid crystal display.

In the above description, the operation in the gate line inversion driving system has been explained. However, this can be applied to either a field inversion driving system or a data line inversion driving system, by changing the control of the polarity inversion circuit and the output selection circuit. Furthermore, it is in many cases that a precharged type liquid crystal display system is incorporated in a projection type projector so configured to display a magnified image by use of a projection lens, and therefore, it is a matter of course that the present invention can be applied.

Advantage of This Embodiment

By using the above mentioned driving method, first, it is possible to realize the precharge operation without providing a dedicated internal circuit for the precharging in the liquid crystal display. Therefore, the size of the liquid crystal display can be reduced, and it is possible to prevent the drop of the production yield attributable to a defect occurring in the dedicated precharge circuit. Secondly, since the video signal is quickly written during a period which is not greater than a half of one horizontal period, and since the precharge voltage is written into the data lines one after one during a remaining period, it is possible to surely write the precharge voltage. Thirdly, since the length of time from the moment the video signal is written into each data line to the moment the precharge voltage is written into the same data line becomes equal among all the data lines, there no longer exists a problem that the effect of the precharging becomes different dependently upon the position of the pixel in the liquid crystal display panel.

Second Embodiment (2) Explanation of Construction

Figure 5:
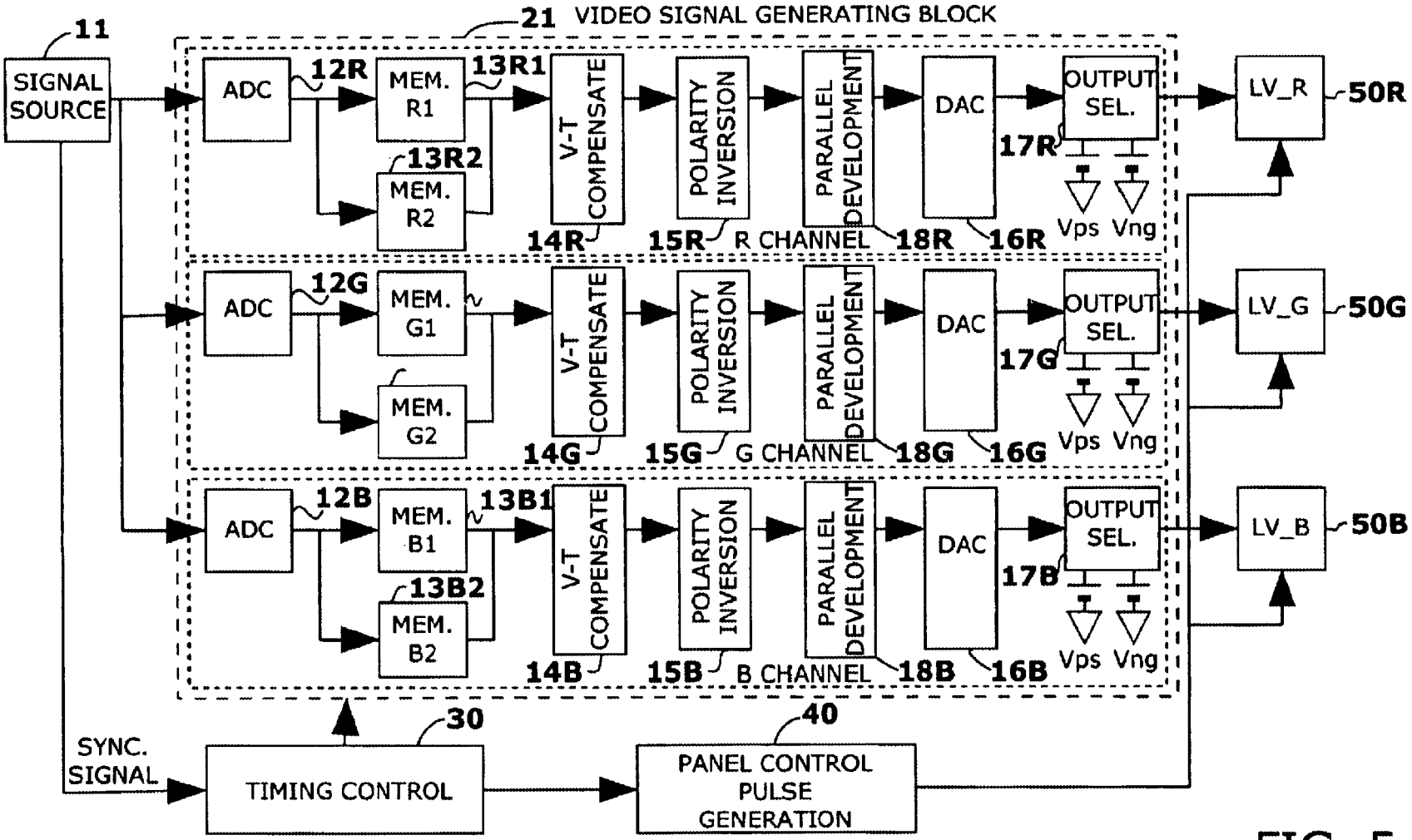
FIG. 5 is a block diagram showing mainly a video signal generating block in accordance with a second embodiment of the present invention.

FIG. 5 shows a block diagram of a panel drive circuit for realizing the method for driving an active matrix type liquid crystal display in accordance with a second embodiment of the present invention. This circuit can be generally divided into a video signal generating block 21, a timing control block 30 and a panel control pulse generation block 40, similarly to the first embodiment mentioned above.

The panel control pulse generation block 40 generates control pulses required to driving an internal circuit of the liquid crystal displays 50, and the video signal generating block 21 generates a video signal to be applied to the liquid crystal displays 50. The timing control block 30 generates signals for controlling the panel control pulse generation block 40 and the video signal generating block 21.

For each of the liquid crystal displays 50 for R (red), G (green) and B (blue), the video signal generating block 21 comprises a ADC circuit 12 for digitizing an analog signal from the signal source 11, two memories 13 each which can hold signals of one line of the liquid crystal display, a V-T compensation circuit 14 for compensating a non-linearity of a transparent light strength to an input voltage of the liquid crystal display 50, a polarity inverting circuit 15 for an AC driving of liquid crystal pixels, a parallel development circuit 18 for a parallel development of the signals, a DAC circuit 16 for converting the digital signal into an analog signal, and an output selection circuit 17 for switching an output to be applied to the liquid crystal display 50.

Figure 6:
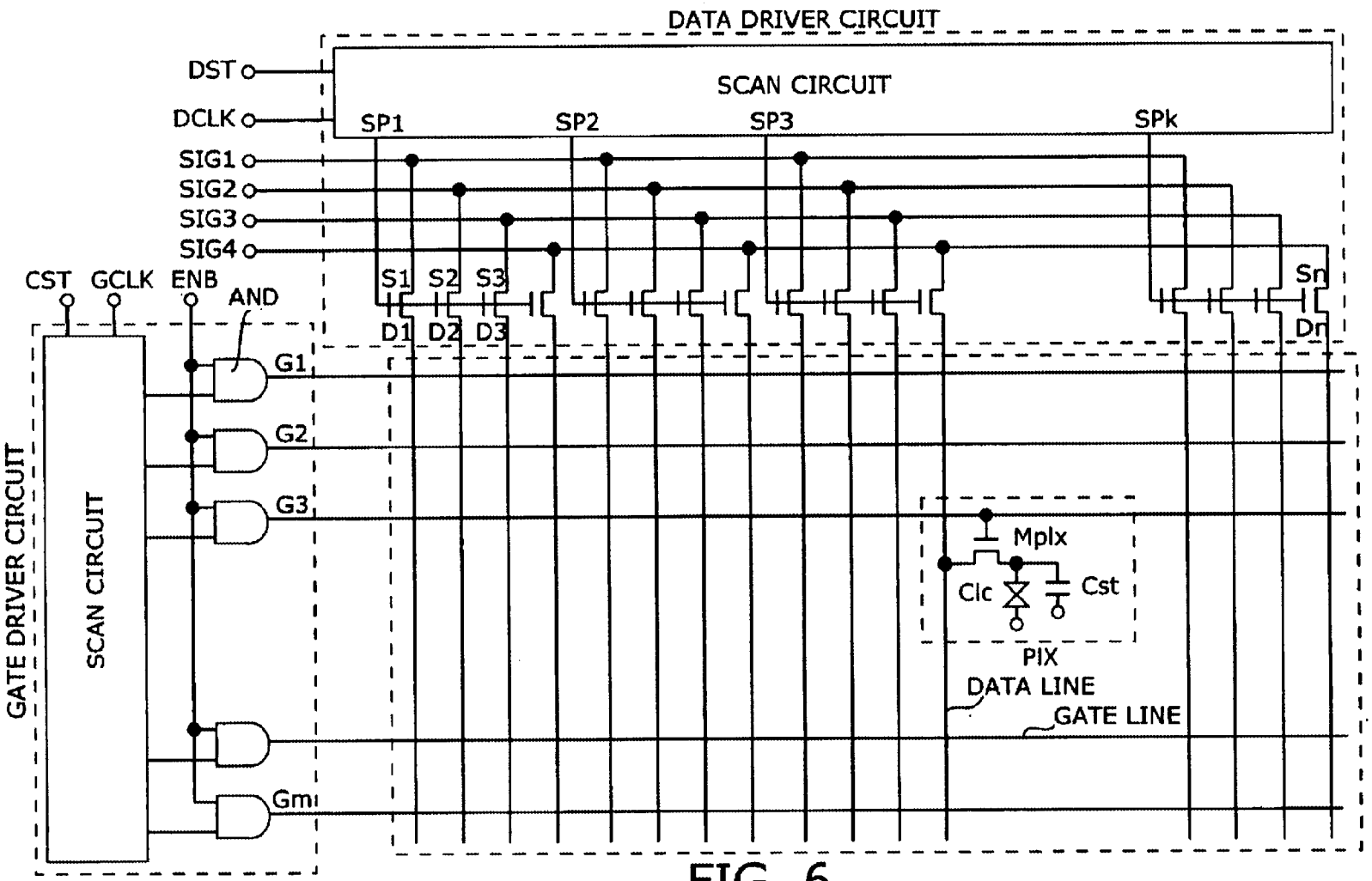
FIG. 6 is a circuit diagram for illustrating a method for driving the liquid crystal display in accordance with the present invention.
Figure 7:
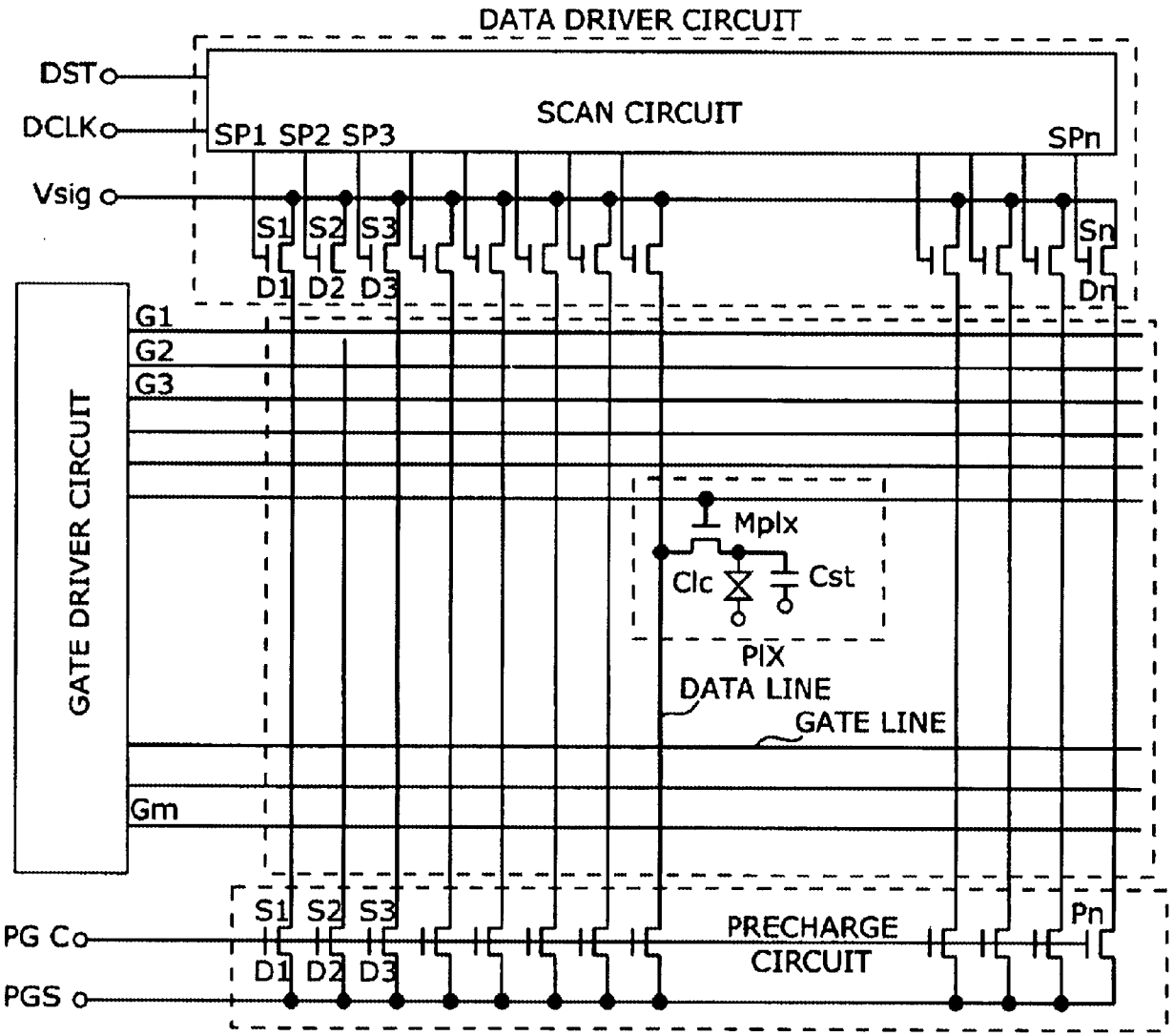
FIG. 7 is a circuit diagram for illustrating a method for driving the liquid crystal display, in accordance with the prior art.
Figure 8:
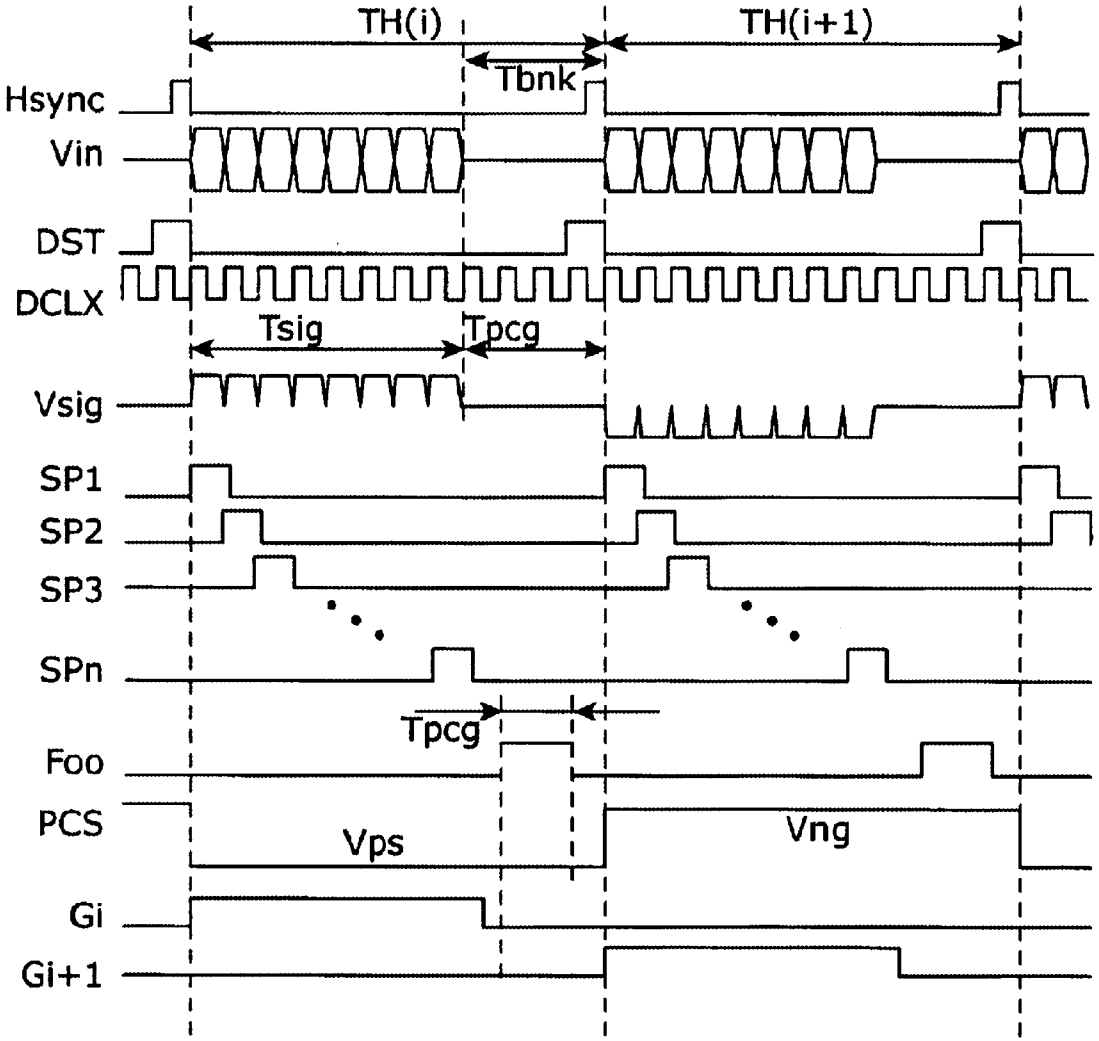
FIG. 8 is a timing chart for illustrating the method for driving the liquid crystal display, in accordance with the prior art.

FIG. 6 shows one example of the construction of an active matrix type liquid crystal display 50 driven by this driving method. The active matrix type liquid crystal display shown in FIG. 6 includes a pixel matrix having pixels PIX each of which is composed of a TFT (Mpix) (which is an active element), a liquid crystal pixel capacitance (Clc) and a storage capacitance (Cst), and which are respectively located at intersections between data lines (D1 to Dn) and gate lines (G1 to Gm) located vertically and horizontally, respectively, a data driver circuit for driving the data lines, a gate driver circuit for driving the gate lines.

The liquid crystal display includes a plurality of video signal wiring conductors for applying a video signal supplied from an external (the drawing shows an example having four video signal wiring conductors Sig1 to Sig4). The data driver circuit is constituted of analog switch (ASW) TFTs of the number which is equal to or more than the number of the data lines, and a scan circuit having outputs of the number which is not smaller than the number obtained by dividing the number of the analog switch TFTs by the number of the video signal wiring conductors (or when the number obtained by the division is not integer, the integer obtained by rounding up the number having a decimal place to an integer).

A drain terminal of every four analog switch (ASW) TFTs are connected to four different video signal wiring conductors, respectively. A gate terminal of each four ASW TFTs are connected to a corresponding one of the output terminals of the scan circuit, through a wiring conductor in common to each four ASW TFTs. A source terminal of the ASW TFTs are connected to the different data lines, respectively. The gate driver circuit is constituted of a scan circuit and an AND gate array. Input terminals of respective AND gates are connected to output terminals of the scan circuit, respectively, at one hand, and in common to a common ENB line at the other hand. An output terminal of the AND gates are connected to the gate lines, respectively.

(2) Explanation of Operation

An operation of the panel driving circuit having the construction of the above mentioned second embodiment is substantially the same as that of the first embodiment, but is different in that the video signal is parallelized by the number of the video signal wiring conductors in the liquid crystal display (here, parallelized into four video signals). Namely, this panel driving circuit operates in such a manner that, once the video signal of one line is read out from the signal source and written into the memory, and then, is read out at a frequency which is not less than a double of the video signal frequency of the signal source, so that the video signal of one line is written into the liquid crystal display during a period which is not greater than a half of one horizontal period, and during the remaining period, the precharge voltage is written into the liquid crystal display. In particular, this panel driving circuit is characterized in that the writing of the video signal into the liquid crystal display and the writing of the precharge voltage into the liquid crystal display can be respectively parallelized by the number of the video signal wiring conductors in the liquid crystal display.

An operation of the liquid crystal display shown in FIG. 6 is substantially the same as that explained in connection with the first embodiment. A difference is that a plurality of video signal wiring conductors are provided, and the analog switches ASW of the same number as that of the video signal wiring conductors are simultaneously driven by the scan circuit, so that the video signals of the corresponding number are sampled in parallel. Therefore, the frequency of the control clock DCLK in the liquid crystal display becomes the value which is obtained by dividing the memory reading clock frequency in the panel driving circuit by the number of the video signal wiring conductors, and the width of the signal DST correspondingly becomes long.

Advantage of This Embodiment

By using the above mentioned driving method, first, an advantage similar to that obtained in the first embodiment can be obtained. In Addition, by parallelizing the sampling of the video signal into the data lines, it is possible to lower the frequency of the video signal applied to the liquid crystal display. This means that the driving frequency of the scan circuit of the data driver circuit can be lowered, whereby the design of the scan circuit can be made easy.

Furthermore, it is constituted of the analog switch (ASW) TFTs of the number which is not less than the number of the data lines, and the scan circuit having the output terminals of the number which is not less than the number obtained by dividing the number of the analog switch (ASW) TFTs by the number of the video signal wiring conductors, the period of the ASWs for sampling the video signal or the precharge voltage can be elongated, so that the performance required for the ASWs can be lowered.

According to the present invention, the precharging circuit which was necessary in the liquid crystal display is no longer necessary, so that the size of the liquid crystal display can be reduced. In addition, it is not necessary to confirm a non-operation of the precharge circuit, and the yield of production can be elevated. Furthermore, since the video signal is quickly written during a period which is not greater than a half of one horizontal period, and since the precharge voltage is written into the data lines one after one during the remaining period, it is possible to surely write the precharge voltage. Moreover, since the length of time from the moment the video signal is written into each data line to the moment the precharge voltage is written into the same data line becomes equal among all the data lines, there no longer exists such a variation that the effect of the precharging becomes different dependently upon the position of the pixel in the liquid crystal display panel, with the result that the quality of the displayed image can be elevated.

What is claimed is:

1. A drive circuit for driving an active matrix type liquid crystal display, comprising a video signal generating block, a timing control block, coupled to the video signal generation block, for supplying timing signals to various parts in the liquid crystal display, and a panel control pulse generation block, coupled to the timing control block, for supplying control pulses for scanning in the liquid crystal display, wherein the video signal generating block for generating a video signal to be supplied to the liquid crystal display, includes, for each of liquid crystal display systems for R (red), G (green) and B (blue), an ADC circuit for converting an analog signal from a signal source of a video signal for a display, into a digital signal, two memories, coupled to the ADC circuit, each having a capacity which can hold signals of one line of the liquid crystal display, a V-T compensation circuits, coupled to the two memories, for compensating a non-linearity of a transmission light strength to an input voltage of the liquid crystal display, a polarity inverting circuit, coupled to the V-T compensation circuit, for an AC driving of liquid crystal pixels in the liquid crystal display, a DAC circuit, coupled to the polarity inverting circuit, for converting the digital signal outputted from said polarity inverting circuit, into an analog signal, and an output selection circuit, coupled to the DAC circuit, for switching an output to be applied to the liquid crystal display, so as to supply the switched output to the liquid crystal display, said output selection circuit being configured to display the analog signal outputted from said DAC circuit, during a period which is a half of one horizontal period of said video signal, and to precharge the liquid crystal display during a latter half of the horizontal period.

2. A method for driving the drive circuit for the liquid crystal display claimed in claim 1, wherein said two memories are alternately repeatedly read and posed, and written and posed, at a double speed in such a manner that when one of the two memories is in a reading condition, the other of the two memories is in a writing condition, and after said output selection circuit outputs the video signal read from the memory, said output selection circuit is put in a precharging period.

3. A method for driving the drive circuit for the liquid crystal display, claimed in claim 2, wherein such an operation is carried out in which once the video signal of one line is stored from said signal source into said memory, said video signal is read out from said memory at a frequency which is not less than a double of the frequency of the video signal of said signal source, so that the video signal of one line is written into the liquid crystal display during a period which is not greater than a half of one horizontal period, and the precharge voltage is written into the liquid crystal display during a remaining period of said one horizontal period.

4. A drive circuit for driving an active matrix type liquid crystal display, comprising a video signal generating block, a timing control block, coupled to the video signal generating block, for supplying timing signals to various parts in the liquid crystal display, and a panel control pulse generation block, coupled to the timing block, for supplying control pulses for scanning in the liquid crystal display, wherein the video signal generating block for generating a video signal to be supplied to the liquid crystal display, includes, for each of liquid crystal display systems for R (red), G (green) and B (blue), an ADC circuit for converting an analog signal from a signal source of a video signal for a display, into a digital signal, two memories, coupled to the ADC circuit, each having a capacity which can hold signals of one line of the liquid crystal display, a V-T compensation circuits coupled to the two memories, for compensating a non-linearity of a transmission light strength to an input voltage of the liquid crystal display, a polarity inverting circuit, coupled to the V-T compensation circuit, for an AC driving of liquid crystal pixels in the liquid crystal display, a parallel development circuit, coupled to the polarity inverting circuit, for developing said video signal into a plurality of parallel video signals, a DAC circuit, coupled to the parallel development circuit, for converting the digital signal outputted from said polarity inverting circuit, into an analog signal, and an output selection circuit, coupled to the DAC circuit, for switching an output to be applied to the liquid crystal display.

5. A method for driving the drive circuit for the liquid crystal display claimed in claim 4, wherein said two memories are alternately repeatedly read and posed, and written and posed, at a double speed in such a manner that when one of the two memories is in a reading condition, the other of the two memories is in a writing condition, and after said output selection circuit outputs the video signal read from the memory, said output selection circuit is put in a precharging period.

6. A method for driving the drive circuit for the liquid crystal display, claimed in claim 5, wherein such an operation is carried out in which once the video signal of one line is stored from said signal source into said memory, said video signal is read out from said memory at a frequency which is not less than a double of the frequency of the video signal of said signal source, so that the video signal of one line is written into the liquid crystal display during a period which is not greater than a half of one horizontal period, and the precharge voltage is written into the liquid crystal display during a remaining period of said one horizontal period, and wherein the writing of the video signal into the liquid crystal display and the writing of the precharge voltage into the liquid crystal display can be respectively parallelized by the number of video signal wiring conductors in the liquid crystal display.

* * * * *